US009545176B1

(12) United States Patent
Finell et al.

(10) Patent No.: US 9,545,176 B1
(45) Date of Patent: Jan. 17, 2017

(54) BATHTUB

(75) Inventors: Rebecca M. Finell, Tempe, AZ (US); Michael Bargiel, Phoenix, AZ (US)

(73) Assignee: BKD ACQUISITION, INC., Oak Brook, IL (US)

( * ) Notice: Subject to any disclaimer, the term of this patent is extended or adjusted under 35 U.S.C. 154(b) by 1936 days.

(21) Appl. No.: 12/621,950

(22) Filed: Nov. 19, 2009

Related U.S. Application Data

(60) Provisional application No. 61/116,555, filed on Nov. 20, 2008.

(51) Int. Cl.
*A47K 3/06* (2006.01)

(52) U.S. Cl.
CPC ..... *A47K 3/06* (2013.01)

(58) Field of Classification Search
CPC ..... A47K 3/12; A47K 3/125; A47K 3/127; A47K 3/164; A47K 3/17; A47K 3/06
USPC . 4/495, 571.1–576.1, 578.1, 589, 594,4/585; 248/146, 150; 220/9.2, 629, 655; 210/232
See application file for complete search history.

(56) References Cited

U.S. PATENT DOCUMENTS

| | | | | |
|---|---|---|---|---|
| 2,143,674 | A | 1/1939 | Berger | |
| 3,799,228 | A | 3/1974 | Crawford | |
| 4,377,191 | A * | 3/1983 | Yamaguchi | 220/665 |
| 5,809,588 | A | 9/1998 | Angelotti | |
| 7,032,259 | B1 | 4/2006 | Kilion | |
| 7,678,271 | B2 | 3/2010 | Curtin | |
| 2007/0251874 | A1 * | 11/2007 | Stewart | 210/232 |
| 2009/0199775 | A1 * | 8/2009 | Shamoon | 119/61.56 |
| 2010/0170840 | A1 | 7/2010 | Curtin | |

FOREIGN PATENT DOCUMENTS

WO 2008103183 8/2008

* cited by examiner

*Primary Examiner* — Tuan N Nguyen
(74) *Attorney, Agent, or Firm* — Michael Best & Friedrich LLP

(57) ABSTRACT

A bathtub includes a base attached to a container. The base is movable between a collapsed position with respect to the container and a deployed position with respect to the container to support the container at an elevated location with respect to a support surface, and the container is movable between a collapsed position with respect to the base and a deployed position with respect to the base to form an open tub to receive a child to be bathed.

21 Claims, 7 Drawing Sheets

BATHTUB

CROSS REFERENCE TO RELATED APPLICATION

This application claims the benefit of U.S. Provisional Patent Application Ser. No. 61/116,555, filed Nov. 20, 2008.

FIELD OF THE INVENTION

The present invention relates to small, portable bathtubs useful in bathing infants and small children.

BACKGROUND OF THE INVENTION

Bathtubs specifically designed and constructed for children are well known in the art. Among such bathtubs are small, stand-alone bathtub systems, support devices placed in a standard bathtub to support a child while being bathed, inflatable bathtubs, collapsible bathtubs relying on a preexisting full size bathtub for support, and bathtub systems operative to restrict the area of a standard bathtub commensurate with the relative size of the child.

SUMMARY OF THE INVENTION

According to the principle of the invention, a bathtub includes a base attached to a container. The base is movable between a collapsed position with respect to the container and a deployed position with respect to the container to support the container at an elevated location with respect to a support surface. The container is movable between a collapsed position with respect to the base and a deployed position with respect to the base to form an open tub to receive a child to be bathed. The base is movable between its collapsed position and its deployed position in the collapsed position of the container and in the deployed position of the container. The container is likewise movable between its collapsed position and its deployed position in the collapsed position of the base and the in the deployed position of the base. The container has a thickness in the collapsed position of the container. In the collapsed position of the base and the collapsed position of the container, the bathtub has an overall thickness substantially equal to the thickness of the container in the collapsed position of the container. Preferably, the container is mounted to the base for movement between a substantially horizontal position with respect to the base and an inclined position with respect to the base.

BRIEF DESCRIPTION OF THE DRAWINGS

Referring to the drawings.

DETAILED DESCRIPTION

Figure 1:
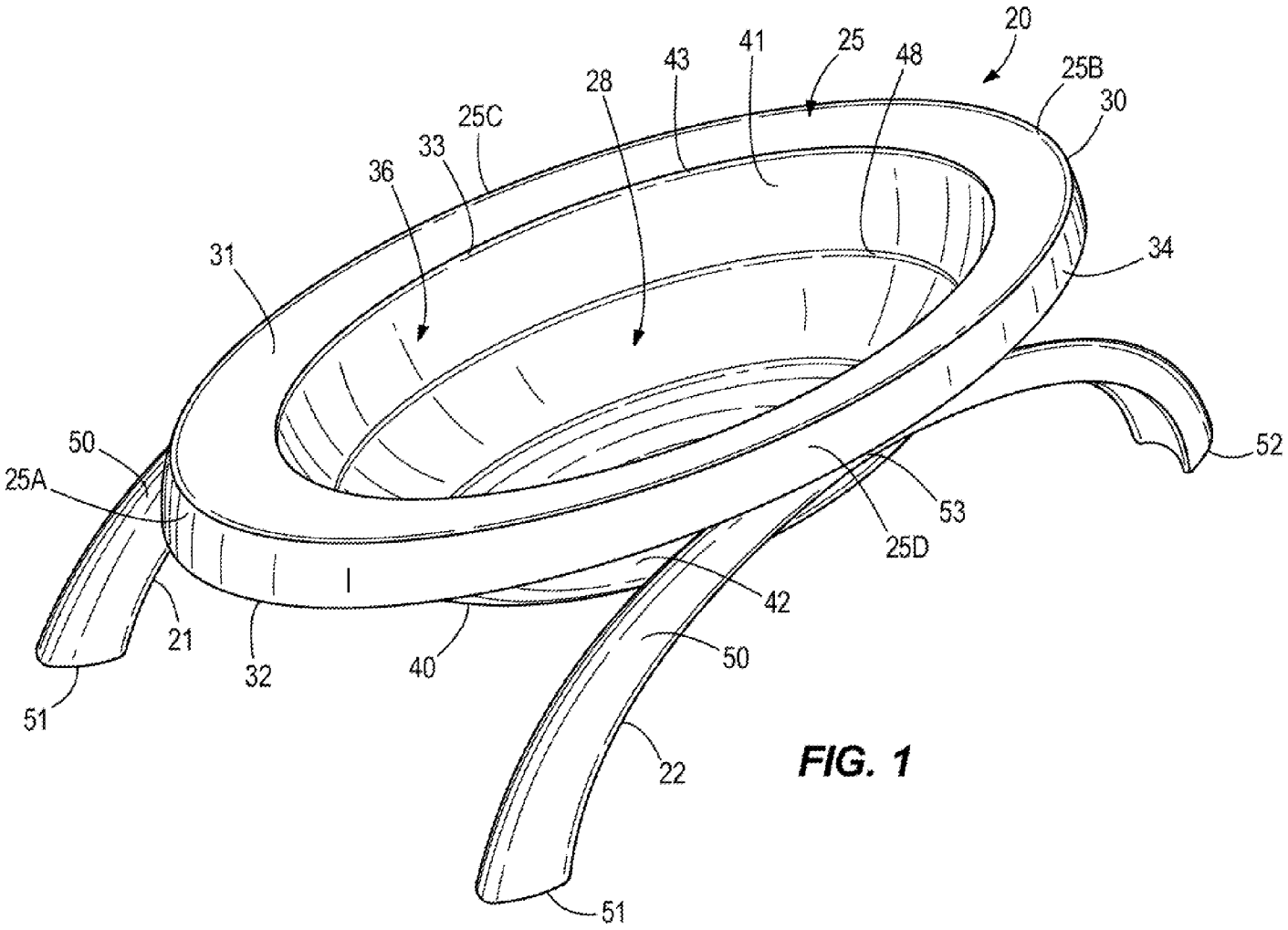
FIG. 1 is a perspective view of a bathtub constructed and arranged in accordance with the principle of the invention, the bathtub including opposed collapsible legs attached to a collapsible container, in which the legs are each movable between a collapsed or closed position and an open or deployed position as shown with respect to the collapsible container to support the collapsible container above a support surface, and the collapsible container is movable between a collapsed or closed position and an open or deployed position with respect to the legs as illustrated forming an open basin or tub that in use is at least partially filled with water to wash the body of a baby or small child positioned within the open basin.
Figure 2:
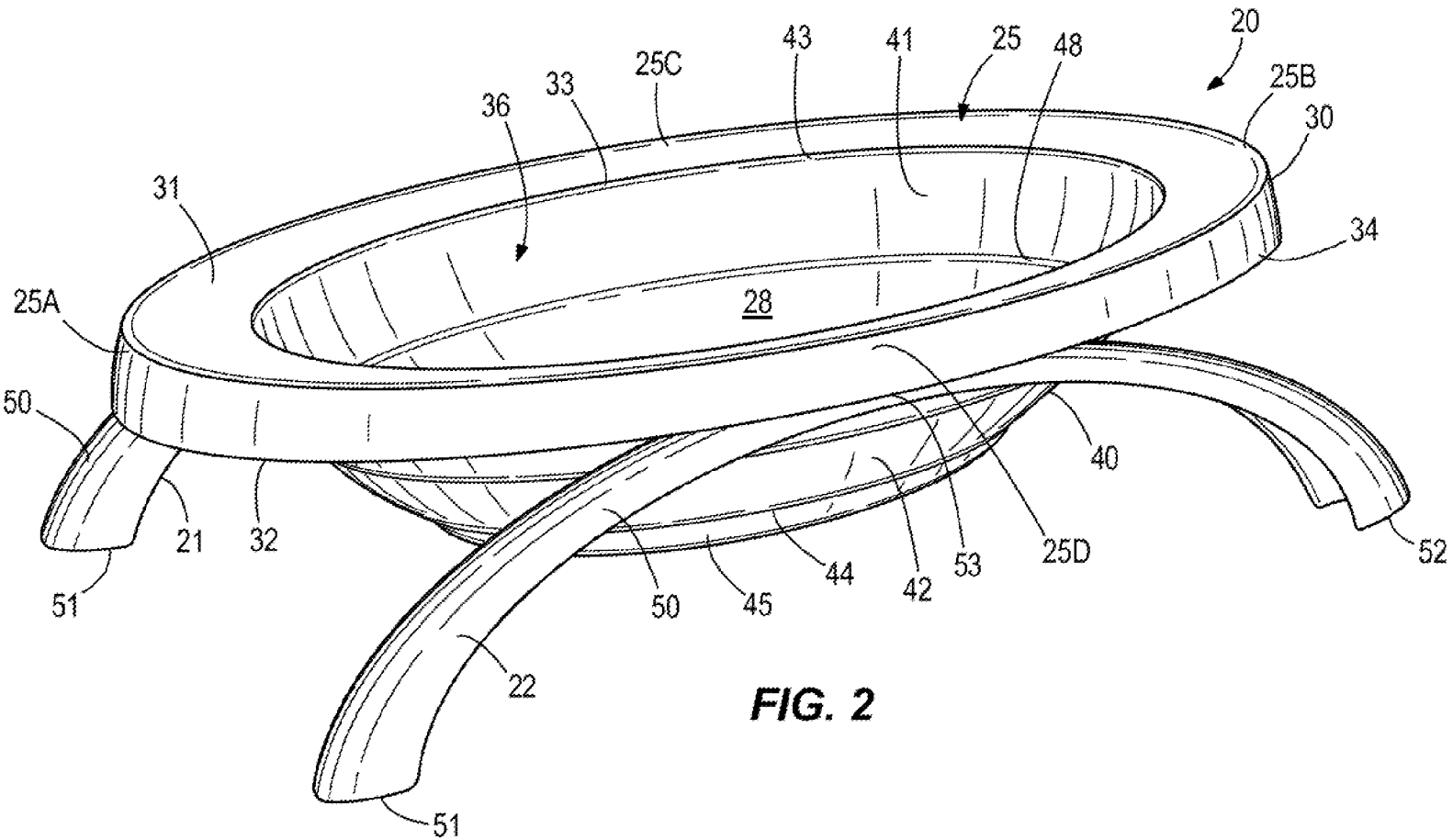
FIG. 2 is another perspective view of the bathtub of FIG. 1 illustrating the legs and the collapsible container disposed in their deployed positions in preparation for use of the bathtub in receiving and washing a baby or small child.

Turning now to the drawings, in which like reference characters indicate corresponding elements throughout the several views, attention is first directed to FIGS. 1 and 2, in which there is seen perspective views of a bathtub 20, constructed and arranged in accordance with the principle of the invention, including collapsible legs 21 and 22 attached to a collapsible container denoted generally at 25. Legs 21 and 22 together form a supporting base for collapsible container 25, and are each movable between a collapsed or closed position and an open or deployed position as shown with respect to collapsible container 25 to support collapsible container 25 at an elevated location with respect to a support surface. Collapsible container 25 is movable between a collapsed or closed position and an open or deployed position with respect to legs 21 and 22 as illustrated forming an open tub, vessel, or basin 28, which is substantially water-impervious and that in use is at least partially filled with water or soapy water or other selected cleansing fluid to wash a baby or small child positioned within open basin 28. Bathtub 20 is lightweight and portable, easily collapsed for storage during periods of nonuse, easily deployed for use in washing a baby or small child, safe, and easy to construct.

Collapsible container 25 consists of an annular body, rim, or frame 30, and an attached tub. Frame 30 is formed of plastic, wood, metal, carbon fiber, or other similarly resilient and rigid material or combination of materials. Frame 30 is preferably integrally formed, but may be fashioned of a plurality of parts bonded or otherwise secured together, such as with adhesive, welding, heat bonding, etc. Snap fit, pin attachments, or other selected mechanical fasteners may be used to interconnect one or more preformed segments or structural pieces to form frame 30, if so desired. In the present embodiment, frame 30 has opposed upper and lower surfaces 31 and 32, and opposed continuous inner and outer marginal extremities 33 and 34. In the present embodiment, frame 30 is substantially oblong in shape as shown in the various figures. Upper surface 31 forms the upper side of frame 30, and lower surface 32 forms the underside of frame 30. Inner marginal extremity 33 encircles and bounds an opening 36. In the present embodiment, opening 36 is oblong or otherwise substantially oval in shape as illustrated.

In the present embodiment, the tub attached to frame 30 is formed by a sidewall 40 attached to a bottom 45. Sidewall 40 includes opposed continuous inner and outer surfaces 41 and 42, a continuous upper edge 43 affixed to continuous inner marginal extremity 33 of frame 30 and which also bounds and encircles opening 36, and an opposed continuous lower edge 44 affixed to a substantially rigid, and substantially bowl-shaped bottom 45. In the present embodiment, bottom 45 is formed of a substantially water impervious resilient and substantially rigid material or combination of materials, such plastic or other like or similar material or combination of materials, and sidewall 40 is formed of a substantially water impervious pliant, flexible, resilient material or combination of materials, such as waterproof cloth or cloth-like material, silicone or other like or similar rubber-like material or combination of materials, softened plastic, or the like. A continuous, resilient band denoted at 48 is formed in sidewall 40 at an intermediate position substantially equidistant and parallel with respect to upper and lower edges 43 and 44. Band 48 is formed of a plastic or other material or combination of materials having a resilient, flexible property. Upper edge 43 is affixed to continuous inner marginal extremity 33 with an aggressive adhesive, and may alternatively be affixed to continuous inner marginal extremity 33 by way of over molding, if possible, or with a mechanical fastening system or with mechanical fasteners, such as pins, rivets, clamping, etc. Lower edge 44 is likewise affixed to bottom 45 with an aggressive adhesive, and may alternatively be affixed to bottom 45 by way of over molding, if possible, or with a mechanical fastening system or with mechanical fasteners, such as pins, rivets, clamping, etc. Other techniques or systems may be used to affix or bond upper edge 43 to continuous inner marginal extremity 33 and lower edge 44 to bottom 45 according to the skill and knowledge attributed to the skilled artisan without departing from the invention.

Collapsible container 25 is overall substantially oblong in shape as illustrated, and has opposed front and rear ends generally denoted at 25A and 25B, respectively, and opposed sides generally denoted at 25C and 25D, respectively. Sides 25C and 25D are greater in length compared to the lengths of ends 25A and 25B. Legs 21 and 22 are attached to frame 30 at sides 25C and 25D, respectively, of collapsible container 25, and are parallel with respect to each other. Legs 21 and 22 are identical in structure and function. As such, only the details of leg 22 will be discussed, with the understanding that the ensuing discussion of leg 22 applies in every respect to leg 21.

Figure 3:
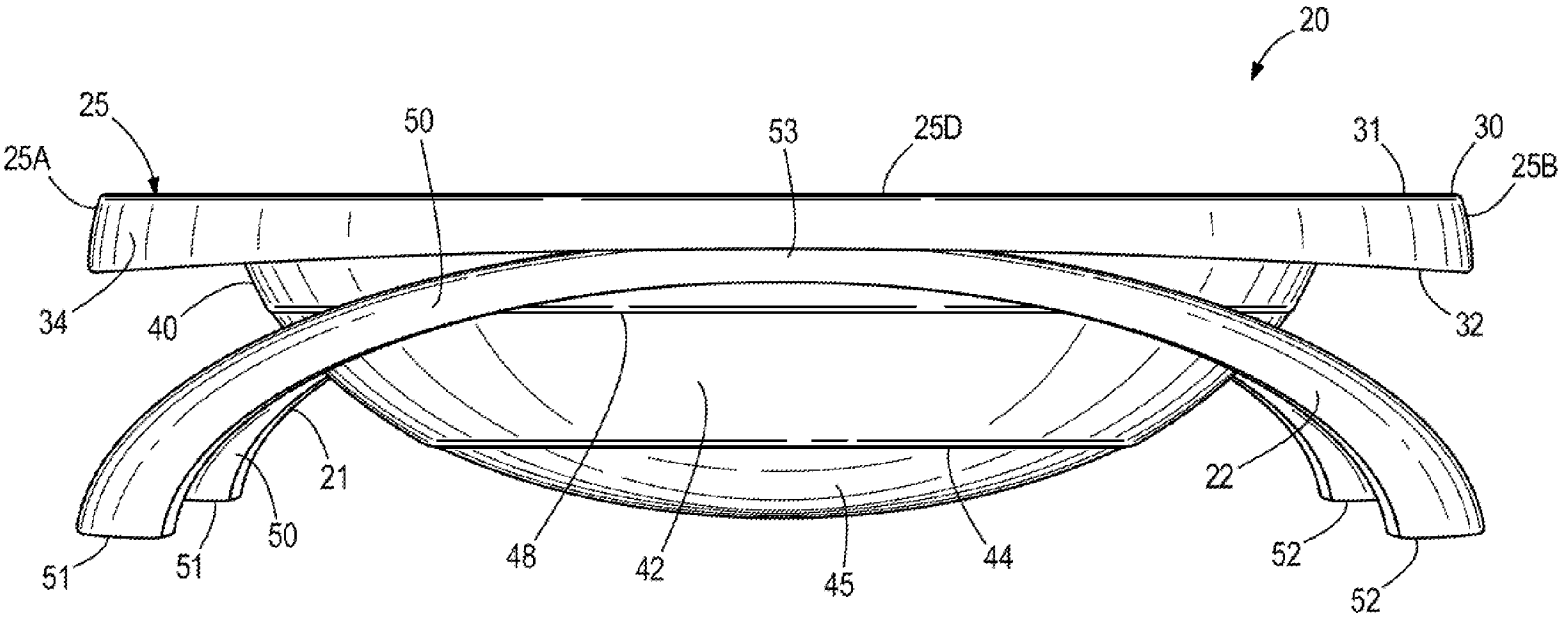
FIG. 3 is a side elevation view of the bathtub of FIG. 1 illustrating the legs and the collapsible container disposed in their deployed positions in preparation for use of the bathtub in receiving and washing a baby or small child.

Referencing FIGS. 1-3, leg 22 consists of an elongate body 50 formed of plastic, wood, metal, carbon fiber, or other similarly resilient and rigid material or combination of materials. Elongate body 50 forming leg 22 is preferably integrally formed, but may be fashioned of a plurality of parts bonded or otherwise secured together, such as with adhesive, welding, heat bonding, etc. Elongate body 50 is formed substantially in the shape of an arch in the present embodiment, and has opposed outer ends 51 and 52, and arches upwardly therefrom to an intermediate portion 53 therebetween, which is affixed to the underside or lower surface 32 of frame 30 outboard of outer surface 42 of sidewall 40. The attachment point at intermediate portion 53 of elongate body 50 is substantially equidistant with respect to outer ends 51 and 52, respectively.

Figure 6:
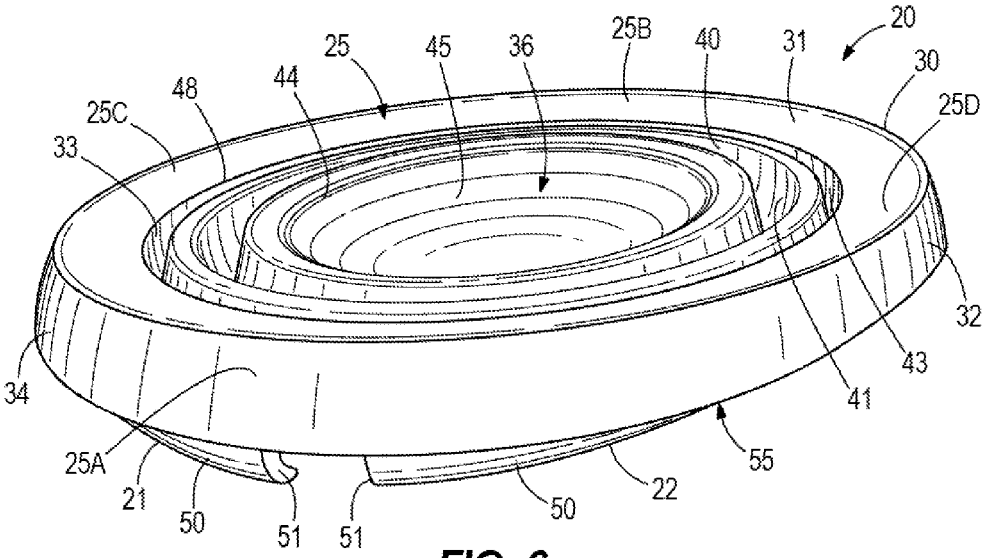
FIG. 6 is a perspective view of the bathtub of FIG. 1 showing the legs in their collapsed positions with respect to the collapsible container disposed in its collapsed or closed position defining the collapsed orientation of the bathtub in preparation for storage.

Leg 22 has a length that is substantially equal to the length of collapsible container 25 from front end 25A to rear end 25B, and is movable between a collapsed or closed position with respect to collapsible container 25 in juxtaposition with respect to lower surface 32 or the underside of frame 30 as illustrated in FIG. 6, and an open or deployed position with respect to collapsible container 25, as shown in FIGS. 1-4, 9, and 10, extending away from lower surface 32 or the underside of frame 30 to support collapsible container 25 above a support surface. In the collapsed or closed position of leg 22, leg 22 extends along the underside of frame 30 along side 25D of collapsible container 25 in juxtaposition with respect to lower surface 42 of frame 30, in which outer ends 51 and 52 extend toward front and rear ends 25A and 25B, respectively of collapsible container 25. Moreover, and with reference to FIG. 6, leg 22 is also actually at least partially received in a cavity or recess, denoted generally at 55, formed in the underside or lower surface 32 of frame 30 in the collapsed position of leg 22, which forms a more compact arrangement between frame 30 and leg 22 in the collapsed position of leg 22 with respect to frame 30. Cavity or recess 55 formed in the underside or lower surface 32 of frame 30 extends along substantially the entire length of frame 30 from front end 25A to rear end 25B, and is shaped to at least partially receive leg 22 in the closed position of leg 22.

Leg 22 has a curvature that conforms substantially to the curvature of frame 30 under which leg 22 resides, and partially encircles sidewall 40 in juxtaposition with respect to the attachment of sidewall 40 to and extending along frame 30. In the deployed or open position of leg 22, leg 22 extends downward from the underside of frame 30 at side 25D of collapsible container 25 from intermediate portion 53 to outer ends 51 and 52 to be positioned upon a support surface. Leg 22 pivots between its collapsed and deployed positions, and a pivotal coupling formed between intermediate portion 53 and frame 30 is provided to not only attach leg 22 to frame 30 but also allow pivotal movement of leg 22 between its collapsed and deployed positions. A detent locking mechanism or system or the like is applied between leg 22 and frame 30 to secure leg 22 in its collapsed position and to secure leg 22 in its deployed position.

Figure 7:
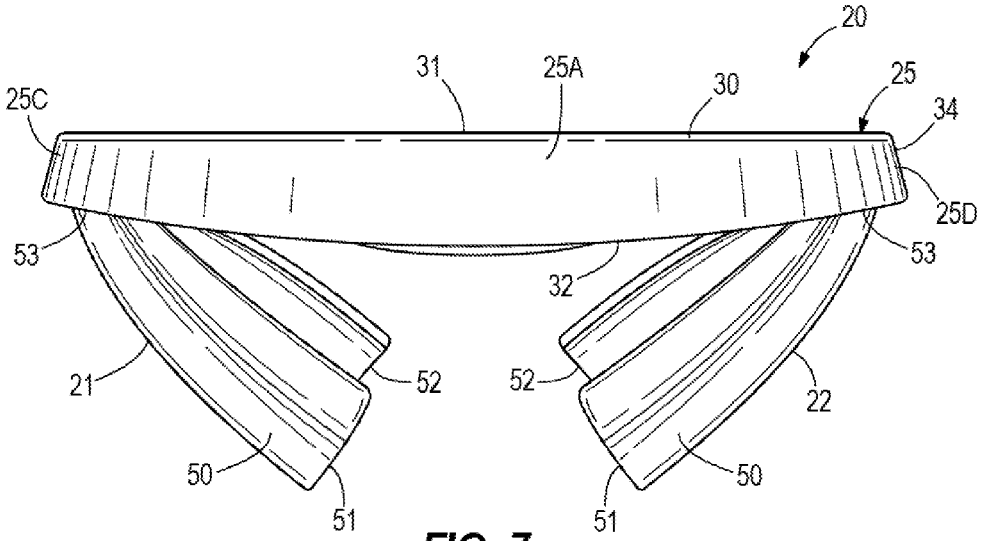
FIG. 7 is a front elevation view of the bathtub of FIG. 1 showing the legs partially deployed with respect to the collapsible container disposed in its collapsed or closed position.
Figure 8:
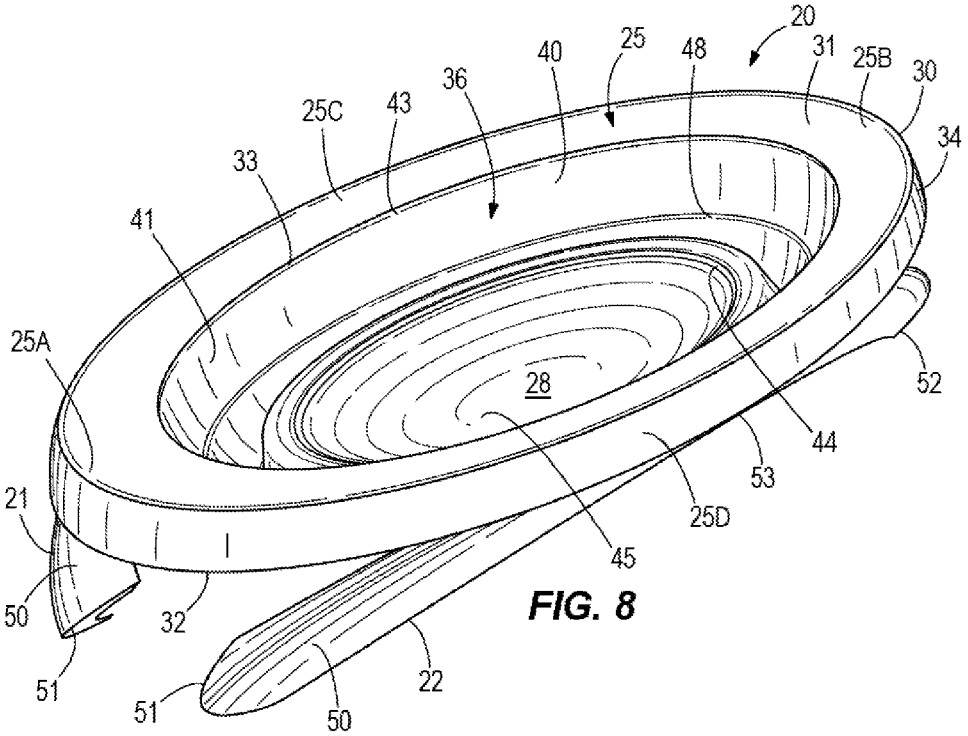
FIG. 8 is a perspective view of the bathtub of FIG. 1 showing the legs partially deployed with respect to the collapsible container also shown partially deployed.

In the collapsed or closed positions of legs 21 and 22, legs 21 and 22 are considered disposed in their stored positions. In the deployed or open positions of legs 21 and 22, legs 21 and 22 are considered in deployed in their operative positions, wherein outer ends 51 and 52 of legs 21 and 22 may be positioned upon a supporting surface for supporting collapsible container 25 at an elevated location in preparation for use of collapsible container 25 in washing a small child or baby. As a matter of illustration and reference, FIGS. 7 and 8 illustrate legs 21 and 22 as they would appear partially deployed with respect to the collapsible container 25 positioned at an intermediate position between their collapsed or closed positions as illustrated in FIG. 6, and their deployed or open positions as illustrated in FIGS. 1-4, 9, and 10.

Legs 21 and 22 provide a stable supporting platform for collapsible container 25. In this particular embodiment, legs 21 and 22 are movable between their collapsed and deployed positions in both of the collapsed and deployed positions of collapsible container 25, and collapsible container 25 is movable between its collapsed and deployed positions in both of the collapsed and deployed positions of legs 21 and 22. In other embodiments constructed and arranged in accordance with the provisions of the invention provided by this disclosure, legs 21 and 22 need not be movable between their collapsed and deployed positions in both of the collapsed and deployed positions of collapsible container 25, and collapsible container 25 need not be movable between its collapsed and deployed positions in both of the collapsed and deployed positions of legs 21 and 22. Although a pair of opposed legs 21 and 22 are utilized in connection with the preferred embodiment disclosed herein, more can be provided without interfering with the preferred use and operation of bathtub 20 without departing from the invention. Also, legs 21 and 22 may each be divided or otherwise provided as two pivotally attached legs, if so desired.

As previously mentioned, collapsible container 25 is movable between a collapsed or closed position as illustrated in FIGS. 4-7 with respect to legs 21 and 22, and an open or deployed position with respect to legs 21 and 22 as illustrated in FIGS. 1-3, and 10 forming open tub basin 28 referenced in FIGS. 1 and 2 that in use is at least partially filled with water, soapy water, or other cleansing fluid to wash a baby or small child positioned within open basin 28. Movement of collapsible container 25 between its collapsed and deployed positions is provided by the structure of sidewall 40 and bottom 45 attached to sidewall 45.

As previously mentioned, sidewall 40 is formed of a pliant, flexible, resilient material or combination of materials, and is formed with continuous, resilient band denoted at 48 formed in sidewall 40 at an intermediate position substantially equidistant and parallel with respect to upper edge 43 of sidewall 40 affixed to frame 30 and lower edge 44 affixed to bottom 45. Band 48 is biased circumferentially outward, and imparts circumferential structural rigidity to sidewall 40. This structure of sidewall 40 in conjunction with bottom 45, and the elasticity of sidewall permits movement of the tub formed by sidewall 40 and bottom 45 between a closed or collapsed position in FIGS. 4-7 and an open or deployed position in FIGS. 1-3 forming open basin 28, which is a substantially water-impervious vessel that in use is at least partially filled with water to wash the body of a baby or small child positioned within open basin 28.

Figure 4:
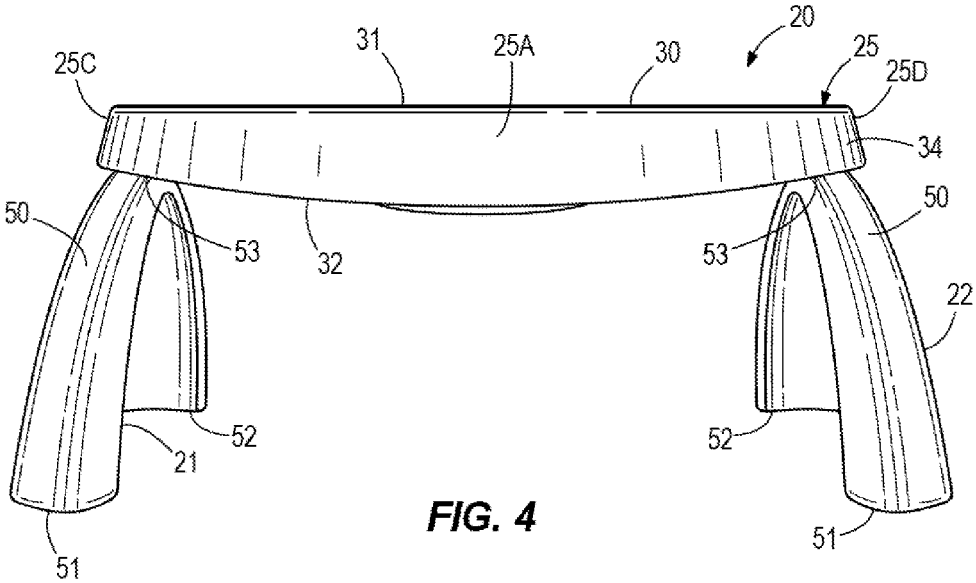
FIG. 4 is a front elevation view of the bathtub of FIG. 1 illustrating the legs and the collapsible container disposed in their deployed positions in preparation for use of the bathtub in receiving and washing a baby or small child.
Figure 5:
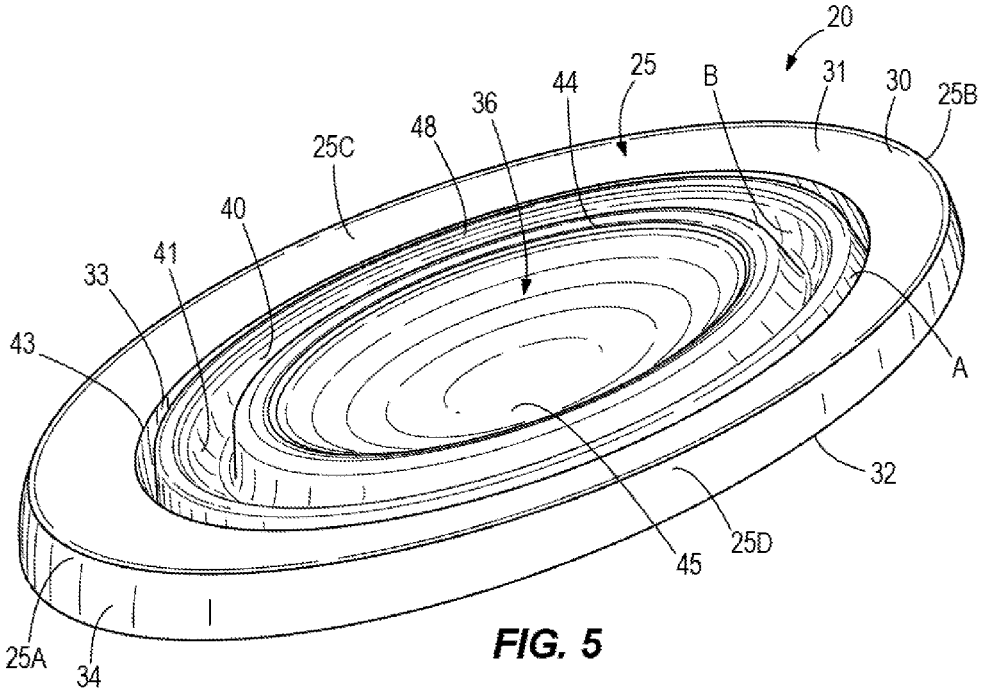
FIG. 5 is a perspective view of the bathtub of FIG. 1 shown as it would appear in a collapsed orientation in preparation for storage.

In the collapsed position of continuous sidewall 40 and bottom 45 of container 25 as illustrated in FIG. 5, sidewall 40 and bottom 45 are retracted upwardly toward frame 30 at opening 36 forming a thin, compact structure of collapsible container 25 having a thickness as seen in FIGS. 4 and 7. In the collapsed position of continuous sidewall 40 and bottom as illustrated in FIG. 5, a resilient fold or pleat A is formed in sidewall 44 between upper edge 43 of sidewall 40 attached to inner marginal extremity 33 of frame 30 and band 48, and another resilient fold or pleat B is formed in sidewall 4 between band 48 and lower edge 44 of sidewall 40 attached to bottom 45. The flexibility and resiliency of sidewall 40 in conjunction with band 48 and bottom 45 form the described resilient folds or pleats in the collapsed position of the tub formed by sidewall 40 and bottom 45. Moreover, frame 30 has a thickness extending from the upper side of frame 30 at upper surface 31 to the underside of frame 30 at lower surface 32, and in the collapsed position of sidewall 40 and bottom 45 both are located at opening 36 substantially within the boundary of the thickness of frame 30 extending from the upper side of frame 30 to the underside of frame 30.

Figure 9:
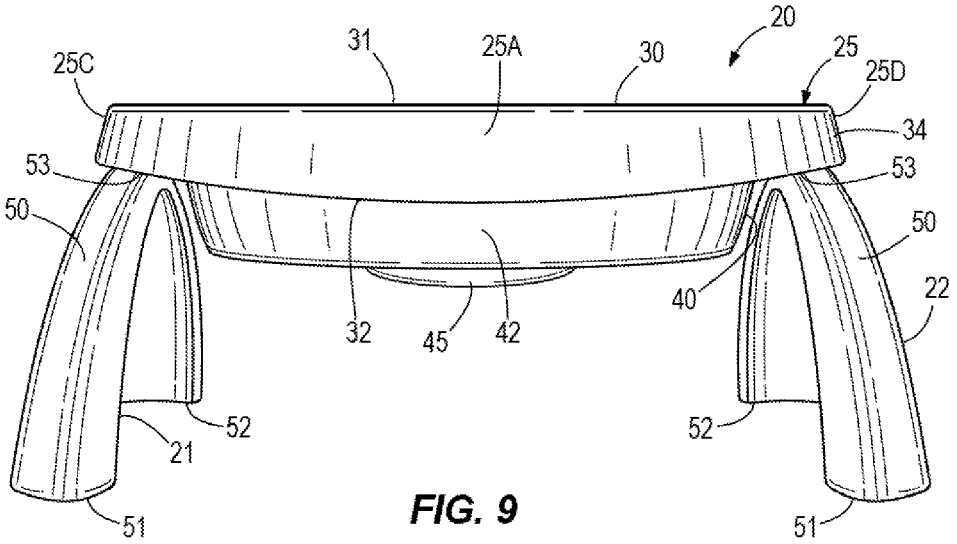
FIG. 9 is a front elevation view of the bathtub of FIG. 1 showing the legs positioned in their deployed positions with respect to the collapsible container shown as it would appear partially deployed.

To move sidewall 40 and bottom 45 from its collapsed position to its deployed position, one need only apply a gentle force to the tub, such as to bottom 45 of the tub, sufficient to influence sidewall 40 to extend sidewall 40 downwardly moving bottom 45 downwardly and away from the underside or lower surface 32 of frame 30 unfolding pleats A and B until sidewall 40 is completely extended as illustrated in FIGS. 1-3, and 10 forming open tub or basin 28. The flexibility and resiliency of sidewall 40 in conjunction with band 48 and bottom 45 cooperate together to maintain sidewall 40 and bottom 45 in the deployed position as illustrated in FIGS. 1-3, and 10. As a matter of illustration and reference, FIG. 9 is a front elevation view of bathtub 20 of FIG. 1 showing legs 21 and 22 positioned in their deployed positions with respect to collapsible container 25, and sidewall 40 and bottom 45 partially deployed disposing collapsible container in a position between its collapsed and deployed positions.

According to this disclosure, bathtub 20 is movable between a collapsed or closed position in the collapsed or closed positions of collapsible container 25 and legs 21 and 22 as illustrated in FIG. 5, and a deployed, open, or operative position in preparation for washing a small child or baby in the deployed or open positions of collapsible container 25 and legs 21 and 22 as illustrated in FIGS. 1-3, and 10. The substantially water impervious vessel or tub formed by open tub or basin 28 in the deployed or open position of collapsible container 25 is sufficiently sized to receive and accommodate a small child or baby to allow caregiver to place a small child or baby into open basin 28 through opening 36 against bottom 45 and inner surface 41 of sidewall 40 and wash the small child or baby. Again, a volume of water, soapy water, or other cleansing fluid may be applied into open basin 28 through opening 36 to assist a caregiver in washing a small child or baby positioned in bottom 45 of open basin 28. In the present embodiment, the oblong shape of open basin 28 helps to hold or cradle a small child or baby positioned therein during bathing, in which the child's back side is presented against bottom 45 and inner surface 41 of sidewall 40, the child's head is located toward rear end 25B of collapsible container 25, and the child's legs are located toward front end 25A of collapsible container 25.

After bathing is complete, bathtub 20 may be rinsed and dried, and moved from its deployed position to its collapsed position as illustrated in FIG. 5 in preparation for storage. In the collapsed position of bathtub 20 as illustrated in FIG. 5, bathtub 20 has a thin and relatively flat profile limited substantially by the thickness of frame 30 extending from the upper side of frame 30 to the lower side of frame 30, and is thus easy to store. Because the thickness of container 25 in its collapsed position as illustrated in FIGS. 4 and 7 is substantially the thickness of frame 30 extending from the upper side of frame 30 at upper surface 31 to the underside of frame 30 at lower surface 32, in the collapsed position of bathtub 20 as illustrated in FIG. 5, bathtub 20 has a thin and relatively flat profile having an overall thickness substantially equal to the thickness of container 25 in the collapsed position of container 25.

Figure 10:
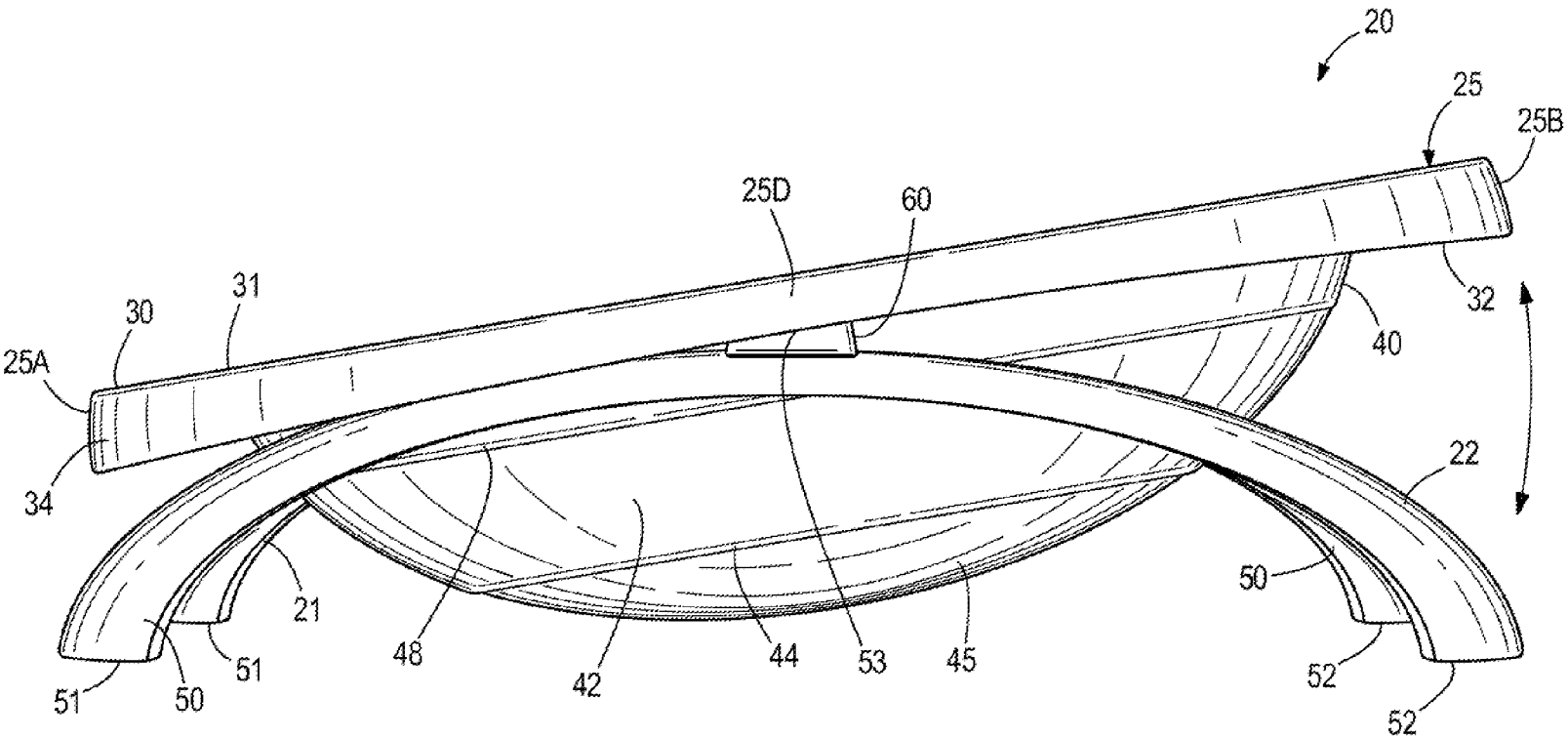
FIG. 10 is a side elevation view of the bathtub of FIG. 1 illustrating the legs and the collapsible container disposed in their open positions in preparation for use of the bathtub in receiving and washing a baby or small child, and the collapsible container shown as it would appear adjusted angularly in an up-angled or inclined position with respect to the legs.

In accordance with a preferred embodiment, frame 30 of collapsible container 25 is preferably mounted to intermediate portions 53 of legs 21 and 22 for pivotal movement with respect to legs 21 and 22 as indicated by the double arcuate arrowed line C in FIG. 10 between a raised or up-angled or inclined positioned as illustrated in FIG. 10 and a lowered or substantially horizontal position as illustrated in FIGS. 1-3. Collapsible container 25 pivots between its inclined and horizontal positions relative to legs 21 and 22, and a pivotal coupling formed between intermediate portion 53 of each of legs 21 and 22 and frame 30 is provided to allow pivotal movement of collapsible container 25 between its inclined and horizontal positions. A locking mechanism or system is applied between each of legs 21 and 22 and frame 30 to secure collapsible container 25 in its inclined and horizontal positions. As a matter of illustration and reference, FIG. 10 illustrates a locking mechanism 60 formed between intermediate portion 53 of leg 22 and frame 30, which is used to lock collapsible container 25 in its raised and lowered positions with respect to leg 22, and at one or more selected positions between lowered and raised positions.

The ability to tilt collapsible container 25 into a raised or inclined position as illustrated in FIG. 10, a lowered or horizontal position as illustrated in FIG. 1, and one or more selected positions between the inclined and horizontal positions allows a caregiver to orient collapsible container 25 at a specified position to best assist a caregiver in washing a small child or baby with the use of bathtub 20, and to provide the most comfortable position for a small child or baby positioned in open basin 28. In the horizontal position of collapsible container 25, open basin 28 holds more water for bathing older children. In the inclined position of collapsible container 25, open basin 28 holds less water for safely bathing smaller children.

The locking mechanism formed between each of legs 21 and 22 and frame 30 of collapsible container 25 includes a detent locking mechanism defining different locking points between collapsible container 25 and legs. If desired, a ratchet-style locking mechanism or other similar or like locking mechanisms can be used to secure collapsible container 25 at its inclined and horizontal positions with respect to legs 21 and 22 and at one or more selected positions therebetween without departing from the spirit and scope of the invention. If desired, the locking mechanism formed between each of legs 21 and 22 may be formed with or otherwise associated with a tab, switch, or other indicator to indicate the locked position of the locking mechanisms to ensure a caregiver preparing to wash a baby or small child that bathtub 20 is secured in ready for safe use.

The invention has been described above with reference to a preferred embodiment. However, those skilled in the art will recognize that changes and modifications may be made to the embodiment without departing from the nature and scope of the invention. For instance, sidewall 40 and bowl 45 together forming the deployable tub or basin of bathtub 20 can be formed from a contiguous or integrated piece of waterproof cloth, softened plastic, elastomer, rubber or rubber-like material, or the like, without departing from the invention. Also, although collapsible container 25 is overall substantially oblong or oval in shape as provided by the corresponding oblong or oval shapes of frame 30 and the tub formed by sidewall 40 and bottom 45, other shapes can be employed, such as round, rectangular, etc. Furthermore, although legs 21 and 22 are attached to frame 30 of collapsible container 25 at sides 25C and 25D, respectively, they may be attached to frame 30 at other locations, such as ends 25A and 25B, respectively. Moreover, although sidewall 40 is formed with one band 48, sidewall 40 can be formed with a plurality of parallel, spaced apart bands formed in sidewall 40 between and parallel with respect to upper and lower edges 43 and 44 of sidewall.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A bathtub, comprising:

a frame;

a container extending from the frame, the container including a water impervious, rigid bottom surface and a centerline extending substantially perpendicular to the bottom surface;

a plurality of leg assemblies coupled to the frame, the plurality of leg assemblies movable between a first collapsed position with respect to the frame, and a first deployed position with respect to the frame to support the container at an elevated location with respect to a support surface, the plurality of leg assemblies extending from the container in a direction away from the centerline of the container when in the first deployed position; and the container movable between a second collapsed position, and a second deployed position to form an open tub to receive a child to be bathed.

2. The bathtub according to claim 1, wherein the plurality of leg assemblies are movable between the first collapsed position and the first deployed position in the second collapsed position of the container and the second deployed position of the container.

3. The bathtub according to claim 1, wherein the container is movable between the second collapsed position and the second deployed position in the first collapsed position of the plurality of leg assemblies and the first deployed position of the plurality of leg assemblies.

4. The bathtub according to claim 1, further comprising:

the container having a thickness in the second collapsed position of the container; and in the first and second collapsed position of the plurality of leg assemblies and the container, respectively, the bathtub has an overall thickness substantially equal to the thickness of the container in the second collapsed position of the container.

5. The bathtub according to claim 1, wherein the bottom surface is movable between a substantially horizontal position with respect to the support surface and an inclined position with respect to the support surface.

6. The bathtub according to claim 5, wherein the frame defines a distance in a direction substantially parallel to the centerline, and wherein the bottom surface extends substantially within the defined distance of the frame when the container is in the second collapsed position.

7. The bathtub according to claim 1, wherein an upper edge of the container defines a periphery extending opposite the bottom surface, and wherein the frame is connected to the container at the periphery.

8. The bathtub according to claim 1, wherein the plurality of leg assemblies are pivotally coupled to the frame.

9. The bathtub according to claim 1, wherein each leg assembly includes two legs and wherein each of the legs defines a respective angle relative to the centerline when the plurality of leg assemblies is in the first deployed position, and wherein each angle is greater than about 90 degrees.

10. The bathtub according to claim 1, further comprising a locking mechanism coupled to the frame and the plurality of leg assemblies to secure the leg assemblies in at least one of the first collapsed and first deployed positions.

11. The bathtub according to claim 1, wherein the container includes a water impervious sidewall extending between the bottom surface and the frame.

12. A bathtub, comprising:

a frame;

a container including a sidewall and a water impervious, rigid bottom wall, an upper edge of the sidewall connected to the frame, and a centerline extending substantially perpendicular to the bottom wall, the container movable between a first collapsed position and a first deployed position, the sidewall comprising a band of material configured to fold and form a first pleat and a second pleat when in the first collapsed position;

a leg assembly pivotally coupled to the frame, the leg assembly movable between a second collapsed position with respect to the frame, and a second deployed position with respect to the frame to support the container at an elevated location with respect to a support surface, the leg assembly extending from the frame in a direction away from the centerline when the leg assembly is in the second deployed position.

13. The bathtub according to claim 12, wherein the leg assembly is movable between the second collapsed position and the second deployed position in the first collapsed position of the container and the first deployed position of the container.

14. The bathtub according to claim 12, wherein the container is movable between the first collapsed position and the first deployed position in the second collapsed position of the leg assembly and the second deployed position of the leg assembly.

15. The bathtub according to claim 12, further comprising:

the container having a thickness in the first collapsed position of the container; and in the first and second collapsed position of the container and leg assembly, respectively, the bathtub has an overall thickness substantially equal to the thickness of the container in the second collapsed position of the container.

16. The bathtub according to claim 12, wherein the bottom wall is movable between a substantially horizontal position with respect to the support surface and an inclined position with respect to the support surface.

17. The bathtub according to claim 16, wherein the frame defines a distance in a direction substantially parallel to the centerline, and wherein the bottom wall extends substantially within the defined distance of the frame when the container is in the first collapsed position.

18. The bathtub according to claim 12, wherein an upper edge of the container defines a periphery extending opposite the bottom wall, and wherein the frame is connected to the container at the periphery.

19. The bathtub according to claim 12, further comprising a locking mechanism coupled to the frame and the leg assembly to secure the leg assembly in at least one of the second collapsed position and the second deployed position.

20. The bathtub according to claim 12, wherein the sidewall of the container is water impervious.

21. A bathtub, comprising:

a frame;

a container extending from the frame, the container including a water impervious, rigid bottom surface;

a plurality of leg assemblies coupled to the frame, the plurality of leg assemblies movable between a first collapsed position with respect to the frame, and a first deployed position with respect to the frame to support the container at an elevated location with respect to a support surface; and the container movable between a second collapsed position, and a second deployed position to form an open tub to receive a child to be bathed.

* * * * *